US007238875B2

(12) United States Patent
Aiba

(10) Patent No.: US 7,238,875 B2
(45) Date of Patent: Jul. 3, 2007

(54) ELECTRONIC MUSICAL INSTRUMENT

(75) Inventor: Toshiyuki Aiba, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 28 days.

(21) Appl. No.: 10/753,120

(22) Filed: Jan. 6, 2004

(65) Prior Publication Data

US 2004/0139847 A1 Jul. 22, 2004

(30) Foreign Application Priority Data

Jan. 7, 2003 (JP) ..... 2003-001328

(51) Int. Cl.
*G10H 1/18* (2006.01)

(52) U.S. Cl. ..... 84/722; 84/314 R

(58) Field of Classification Search ..... 84/319, 84/310, 311, 646, 722, 743
See application file for complete search history.

(56) References Cited

U.S. PATENT DOCUMENTS 3,406,603 A * 10/1968 Melita ..... 84/290
3,440,917 A * 4/1969 Lemon ..... 84/267
3,994,196 A * 11/1976 Hamil ..... 84/273
4,919,031 A 4/1990 Matsumoto et al.
5,094,137 A 3/1992 Matsumoto
5,113,742 A 5/1992 Matsumoto
5,467,679 A * 11/1995 Schmidt ..... 84/312 R
5,777,251 A 7/1998 Hotta et al.
6,803,512 B2 * 10/2004 Ishida et al. ..... 84/633

FOREIGN PATENT DOCUMENTS

JP 63-235997 9/1988
JP 5-150777 6/1993
JP 2000-312779 11/2000
JP 2002-258839 9/2002

* cited by examiner

*Primary Examiner*—Jeffrey W Donels
(74) *Attorney, Agent, or Firm*—Morrison & Foerster LLP

(57) ABSTRACT

There is provided an electronic musical instrument which is capable of muting by a simple operation. A plurality of fret operating elements are provided on a fingerboard, for determining the pitch. Six stringed operating elements for determining sounding timing are provided on a string input section of the body of the electronic musical instrument. A tone generator and a sound system generate musical tones according to operations of the fret operating elements and the stringed operating elements. A mute fingerboard larger in transverse size than the transverse region over which the six stringed operating elements are arranged is disposed on an operating element holder protecting section engaged with latches of the operating elements. The mute fingerboard is located in the vicinity of operated ends of the stringed operating elements within the range where the stringed operating elements can be operated, and is exposed on a surface of the body.

5 Claims, 5 Drawing Sheets

ELECTRONIC MUSICAL INSTRUMENT

BACKGROUND OF THE INVENTION

1. Field of the Invention

The present invention relates to an electronic musical instrument such as a string instrument, which detects operations of operating elements such as artificial strings to electronically generate musical tones.

2. Description of the Related Art

Conventionally, as disclosed in Japanese Laid-Open Patent Publication (Kokai) No. 2002-258839, an electronic musical instrument has been known which detects operations of sounding timing determination operating elements such as string members to electronically generate musical tones. This electronic musical instrument as a whole is configured like a guitar, for example, and detects plucking operations of the sounding timing determination operating elements as artificial strings provided at the body of the electronic musical instrument, and generates musical tones according to the resulting detection signals. In this electronic musical instrument, the pitch is determined using a pitch determination operating element provided at the neck, and the sounding timing determination operating elements provided at the body are plucked to determine musical tone generation timing and control the progress of automatic performance.

Further, in this electronic musical instrument, when any of the sounding timing determination operating elements is touched with a finger, the level of a musical tone generated correspondingly to the touched operating element (CH: channel) is lowered by a predetermined value (e.g. 20 db) so that the musical tone can be muted. Therefore, it is possible to generate natural musical tones when the operating elements are plucked again.

In this electronic musical instrument, however, to mute (silence or damp) a musical tone, the player must be quite experienced in playing the musical instrument since he/she has to instantaneously recognize one of the sounding timing determination operating elements, which corresponds to a musical tone being sounded, and touch or depress it with a proper intensity. In particular, it is difficult for a beginner inexperienced in playing the musical instrument to touch a proper string to be muted because he/she is apt to focus all his/her attention on sequentially sounding musical tones.

SUMMARY OF THE INVENTION

It is an object of the present invention to provide an electronic musical instrument which is capable of muting a musical tone by a simple operation.

To attain the above object, in a first aspect of the present invention, there is provided an electronic musical instrument comprising a fingerboard, a plurality of pitch determination operating elements provided on the fingerboard, for determining a pitch, a plurality of sounding timing determination operating elements each having an operated end, provided at a location other than the fingerboard, for determining sounding timing, a musical tone generating device that generates musical tones according to operations of the pitch determination operating elements and the plurality of sounding timing determination operating elements, and at least one mute fingerboard that comes into contact with a part of a player's body to mute musical tones being sounded by the musical tone generating device and corresponding to operations of respective ones of said plurality of sounding timing determination operating elements, and the mute fingerboard is disposed and exposed in a vicinity of the operated end of the plurality of sounding timing determination operating elements.

With the above arrangement according to the first aspect of the present invention, when the palm or the like touches the mute fingerboard, musical tones being generated according to operations of the pitch determination operating elements and the sounding timing determination operating elements are muted. Since the mute fingerboard is disposed and exposed in the vicinity of the operated ends of the sounding timing determination operating elements, the distance which the player has to move his/her hand so as to touch the mute fingerboard can be minimized. For example, the player can easily touch the mute fingerboard with part of the hand which operates the sounding timing determination operating elements (for example, the ball of the thumb), and hence even a beginner inexperienced in performance can easily mute a musical tone. As a result, a musical tone can be muted by a simple operation.

Preferably, the mute fingerboard comprises a single mute fingerboard disposed in the vicinity of the operated ends of all of the plurality of sounding timing determination operating elements.

Alternatively, the mute fingerboard comprises a plurality of mute fingerboards disposed in the vicinity of the operated ends of respective corresponding ones of the plurality of sounding timing determination operating elements.

More preferably, the electronic musical instrument according to the first aspect comprises an operating element holder protecting section having a surface, and the plurality of sounding timing determination operating elements each have a latch engaged with the operating element holder protecting section, and the mute fingerboard is provided on the surface of the operating element holder protecting section.

More preferably, the plurality of sounding timing determination operating elements are arranged transversely of the electronic musical instrument over a transverse region, and the mute fingerboard has a transverse size larger than the transverse region over which the plurality of sounding timing determination operating elements are arranged.

More preferably, the operating element holder protecting section is stepped to have a first surface and a second surface lower than the first surface, and the mute fingerboard is disposed on the second surface of the operating element holder protecting section.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof.

Figure 1:
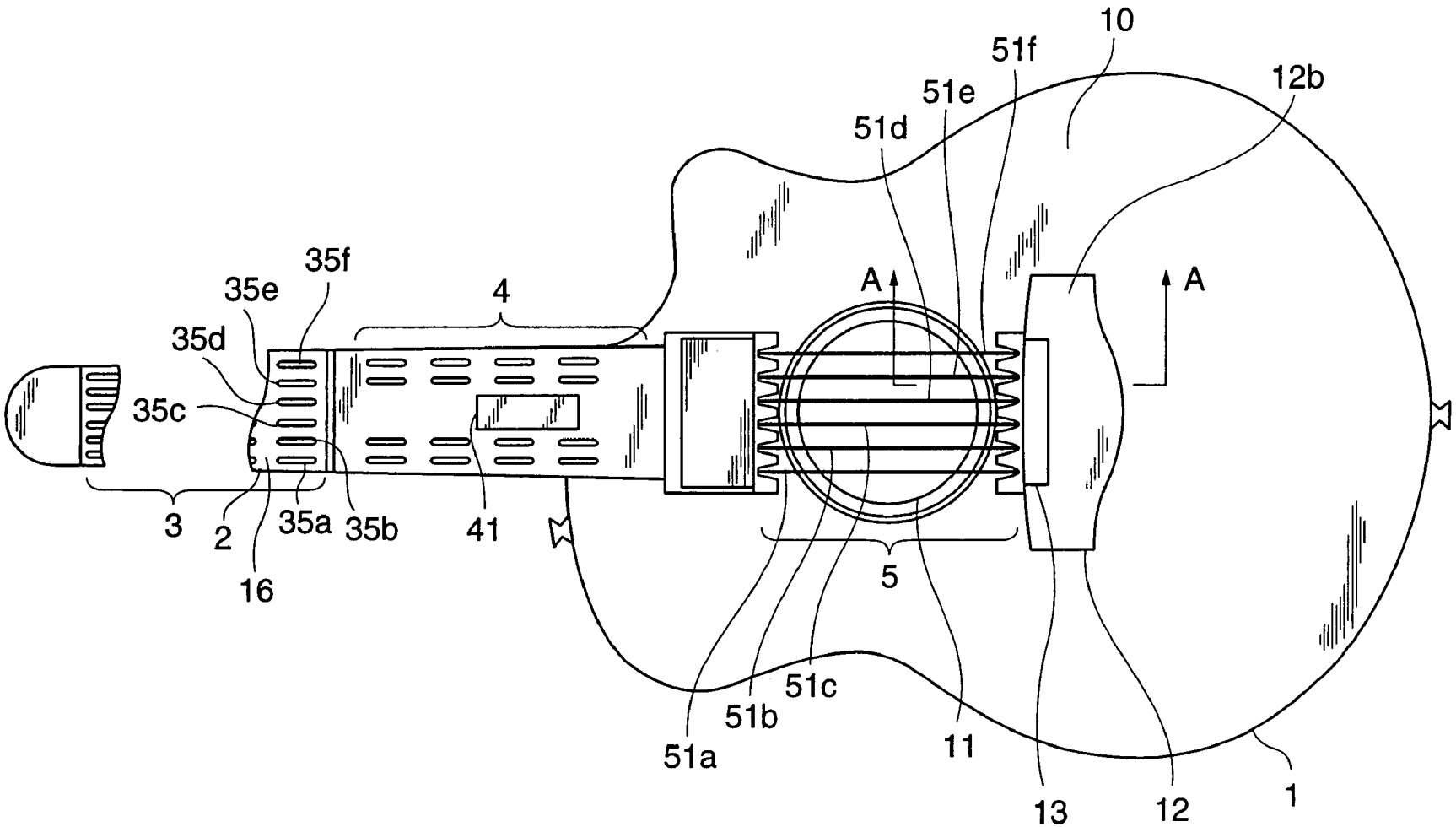
FIG. 1 is a plan view showing an electronic musical instrument according to an embodiment of the present invention.
Figure 2:
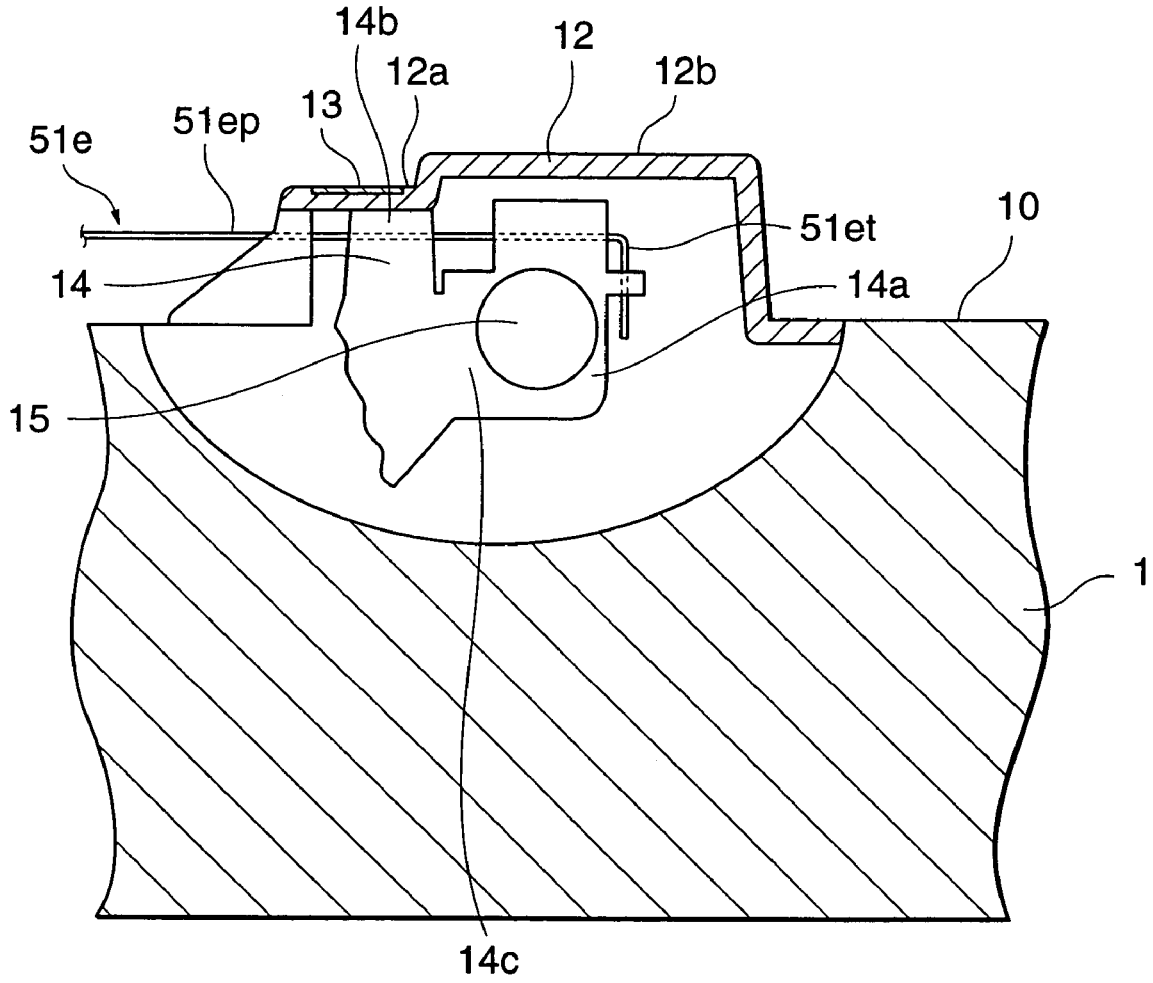
FIG. 2 is a fragmentary sectional view taken along line A—A in FIG. 1.

FIG. 1 is a plan view showing an electronic musical instrument according to an embodiment of the present invention. FIG. 2 is a fragmentary sectional view taken along line A—A in FIG. 1. The electronic musical instrument according to the present embodiment is a guitar type, and is comprised of a body 1 and a neck 2. The neck 2 is provided with a pitch switch section 3 and a panel operating section 4, while the body 1 is provided with a string input section 5 and a memory slot 6 (not shown in FIG. 1), described later. The string input section 5 includes six sounding timing determination operating elements (hereinafter referred to as "the stringed operating elements") 51*a* to 51*f* formed of string members. As is the case with strings of a guitar, the stringed operating elements 51*a* disposed at the outermost location is the thickest, and the other stringed operating elements 51*b* to 51*f* decreases in thickness in this order.

In the electronic musical instrument according to the present embodiment, the pitch is set by operating the pitch switch section 3 with the right hand as in the case where areas between frets of a guitar are touched, and the stringed operating elements 51 of the string input section 5 are plucked with the right hand as in the case where guitar strings are plucked, whereby performance and sounding of an electric guitar can be artificially reproduced.

As shown in FIG. 1, the neck 2 is provided with a fingerboard 16 which corresponds to a fret mounted surface of a guitar and has a plurality of fret operating elements 35 (35*a* to 35*f*) (pitch determination operating elements) thereon. The fret operating elements 35 are arranged in parallel in areas corresponding to areas between frets of a guitar, and six fret operating elements 35 are arranged in parallel in each area between frets in a manner corresponding to the six stringed operating elements 51. For example, the fret operating elements 35*a* to 35*f* correspond to the respective stringed operating elements 51*a* to 51*f*. The body 1 also has a sound hole 11 formed in the string input section 5, and a speaker, not shown, is disposed in the sound hole 11. The panel operating section 4 is provided with a display 41 and a variety of switches, for inputting musical instrument types, setting operation modes, and displaying various kinds of information.

A direction toward the body 1 as viewed from the neck 2 will hereinafter referred to as "the tail direction". The body 1 is provided with an operating element holder protecting section 12. As shown in FIG. 2, the operating element holder protecting section 12 has a mounting member 14 incorporated therein, and a latch 51*et* of the stringed operating element 51*e* is engaged with an end 14*a* of the mounting member 14. A piezo-detector 15 is provided at the end 14*a* of the mounting member 14. Although not described in detail, as is the case with the conventional electronic musical instrument (Japanese Laid-Open Patent Publication (Kokai) No. 2002-258839), when the stringed operating element 51*e* is plucked with a finger, a pick, or the like as in picking, the stringed operating element 51*e* is displaced or bent about a fulcrum 14*b* of the mounting member 14 in a direction in which the stringed operating elements 51 are arranged so that the latch 51*et* moves together with the end 14*a* of the mounting member 14. The piezo-detector 15 moves about a moving center 14*c* of the mounting member 14, and generates an output signal only when the moving acceleration exceeds a predetermined threshold.

The operating element holder protecting section 12 is stepped to have a first surface 12*a* and a second surface 12*b*. A mute fingerboard 13 which has a transverse size larger than a transverse region over which the six stringed operating elements 51 are arranged (refer to FIG. 1) is provided on the first surface 12*a*. The mute fingerboard 13 is located in the vicinity of an operated end 51*ep* which is an end of the stringed operating element 51*e* in the tail direction within where the stringed operating element 51*e* can be operated, and is exposed to the outside. Although the above description has been given by taking the stringed operating element 51*e* as an example, the mute fingerboard 13 is located in the vicinity of operated ends of the other stringed operating elements 51 (51*ap* to 51*dp* and 51*fp*; these reference numerals are not shown), too. The other stringed operating elements 51 and its related component parts are constructed in the same manner as the stringed operating element 51*e* and its related component parts.

Figure 3:
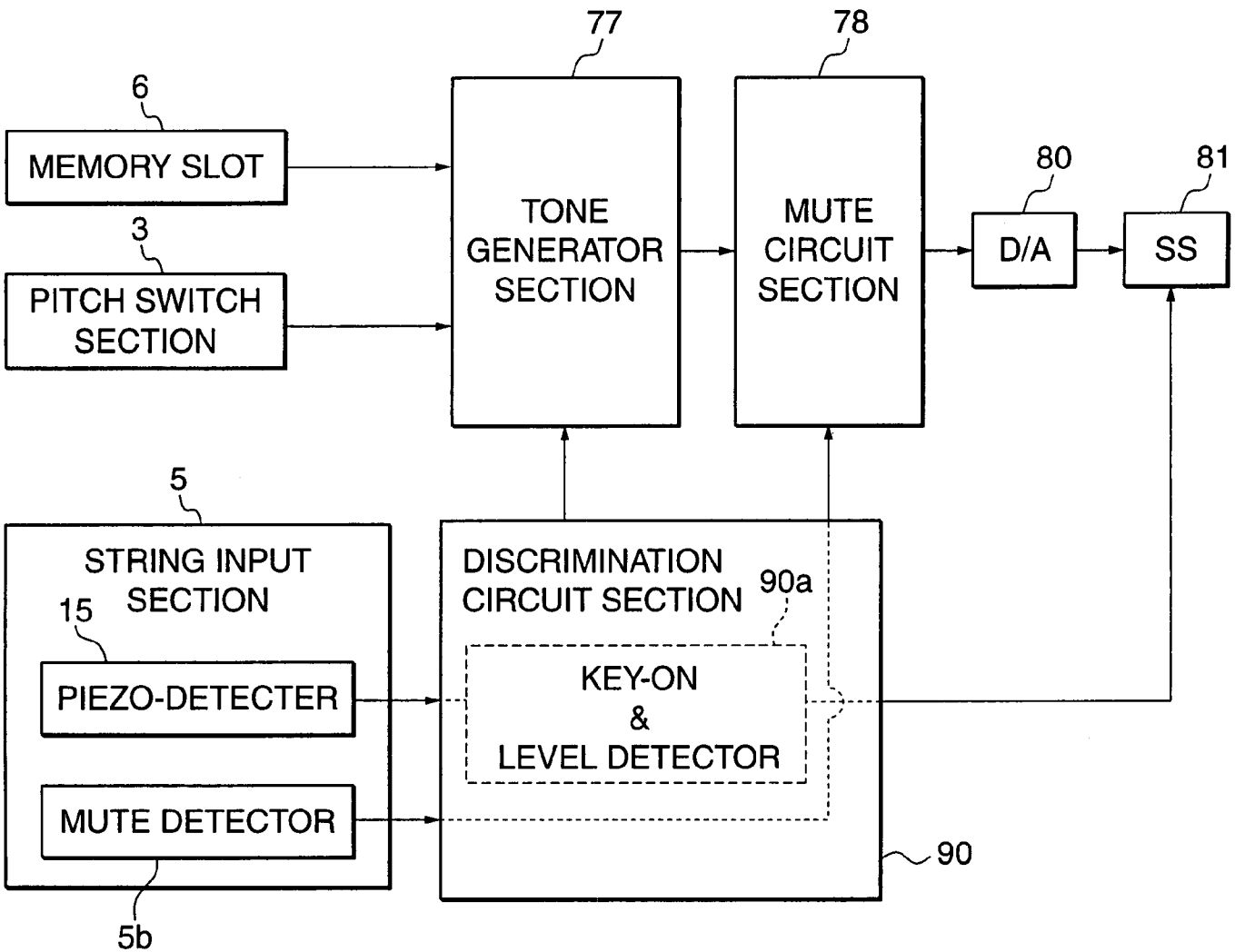
FIG. 3 is a block diagram showing the arrangement of a controller of the electronic musical instrument of FIG. 1.

FIG. 3 is a block diagram showing the arrangement of a controller of the electronic musical instrument of FIG. 1. The memory slot 6 and the pitch switch section 3 are connected to a mute circuit section 78 via a tone generator section 77. The string input section 5 is provided with the piezo-detector 15 and a mute detector 5*b*, which are connected to the tone generator section 77 and the mute circuit section 78 as well as to a sound system (SS) 81 including an amplifier and a speaker, neither of which is shown, via a discrimination circuit section 90. The mute circuit section 78 is connected to the sound system 81 via a D/A converter 80 so that musical tones can be generated from the speaker.

The tone generator section 77 and the sound system (SS) 81 constitute a musical tone generating device.

The pitch switch section 3 outputs a detection signal corresponding to the depressed one of the fret operating elements 35. The detection signal serves as a pitch signal indicative of which one has been depressed among the plurality of fret operating elements 35 corresponding to the respective stringed operating elements 51.

Upon receipt of a first trigger signal, described later, the discrimination circuit section 90 outputs a tone generation instruction signal to the tone generator section 77, and on the other hand, upon receipt of a second trigger signal, described later, the discrimination circuit section 90 outputs a signal which instructs the mute circuit section 78 to mute a musical tone. The discrimination circuit section 90 includes a key-on and level detector 90*a* which is operable when the piezo-detector 15 detects any of the stringed operating element 51 being plucked, to output the first trigger signal for determining sounding timing, extract an envelope of a level signal output from the piezo-detector 15, and then amplify the level signal and supply the same as a control signal CS for controlling the level of the above-mentioned amplifier, not shown, to the sound system 81. As a result, the level of a musical tone can be controlled according to the intensity of plucking.

The mute detector 5*b* is operates in response to detection of the mute fingerboard 13 being touched with the player's finger or the like, to output the second trigger signal to mute all the strings. Musical piece data, for example, stored in a memory card, not shown, are input from the memory slot 6. The mute circuit section 78 is comprised of a circuit which performs operation (multiplication) on a peak value given from the tone generator section 77 and a level value given from the discrimination circuit section 90, and performs operation to decrease the peak value by e.g. 20 db and outputs the resulting value.

A description will now be given of an example of a musical tone generating process according to the present embodiment. A musical tone is generated by plucking each of the stringed operating elements 51, but a muting process is carried out for all the stringed operating elements 51.

When the player depresses one of the fret operating elements 35, a pitch signal indicative of the depressed one of the fret operating elements 35 is output from the pitch switch section 3 to the tone generator section 77. On the other hand, when the player plucks one of the stringed operating elements 51, the first trigger signal is input from the piezo-detector 15 to the discrimination circuit section 90, and is output as a tone generation instruction signal to the tone generator section 77. Then, according to the pitch signal and the tone generation instruction signal input to the tone generator section 77, a musical tone is generated at a pitch indicated by the pitch signal and in timing indicated by the tone generation instruction signal. As a result, a musical tone signal is supplied from the tone generator section 77 to the sound system 81 via the mute circuit section 78 and the D/A converter 80, so that a musical tone is generated from the above-mentioned speaker, not shown.

On the other hand, when the player touches the mute fingerboard 13 with a finger or the like during generation of a musical tone, the second trigger signal is input to the discrimination circuit section 90. In response to the second trigger signal, the discrimination circuit section 90 transmits a signal indicative of a muting instruction to the mute circuit section 78, which then performs muting processing on the signal output from the tone generator section 77. Specifically, to mute all the musical tones being sounded, the musical tone level output from the tone generator section 77 is lowered by a predetermined value (e.g. 20 db). As a result, when a musical tone is muted, the level thereof can be changed in a natural way.

Figure 4:
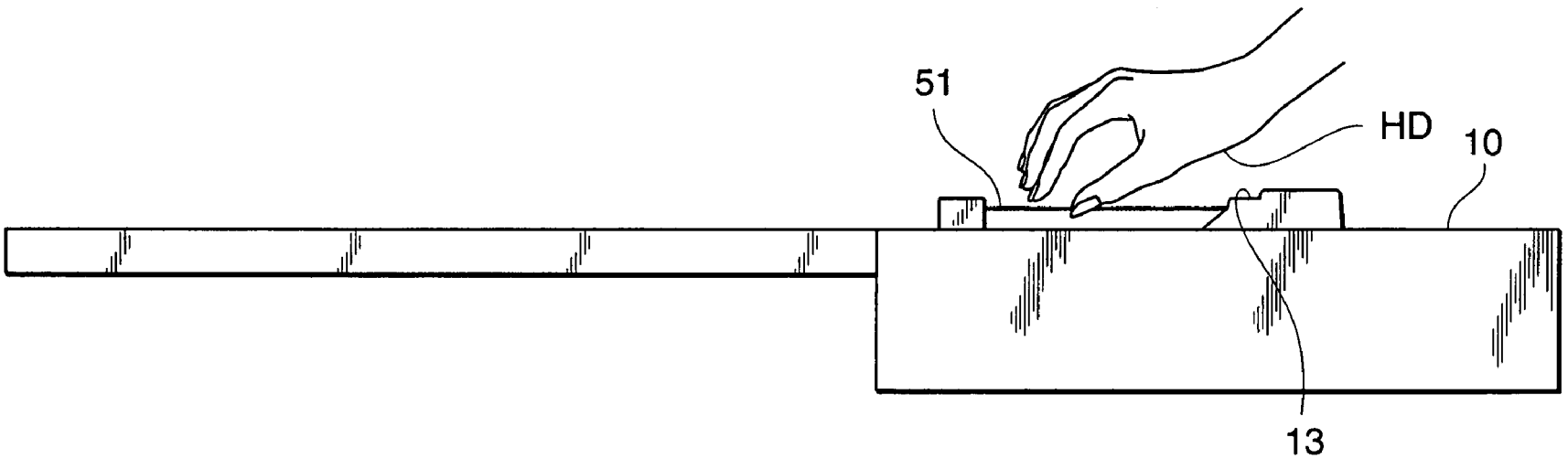
FIG. 4 is a side view schematically showing the electronic musical instrument of FIG. 1.

FIG. 4 is a side view schematically showing the electronic musical instrument of FIG. 1. It is assumed that in the electronic musical instrument, a touch portion HD of the player's right hand near the boundary between the hand and the wrist, including an area in the vicinity of the ball of the thumb, touches the mute fiberboard 13. Namely, as described above, the mute fingerboard 13 is disposed and exposed in the vicinity of the operated end 51(*ep*) which is the end of the stringed operating element 51(*e*) in the tail direction within the range where the stringed operating element 51(*e*) can be operated (refer to FIG. 2), and hence when the player is plucking the stringed operating element 51, the touch portion HD of the player's right hand lies at a position relatively close to the mute fingerboard 13. Specifically, the mute fingerboard 13 is usually positioned in the vicinity of the touch portion HD. Therefore, the distance over which the player has to move his/her hand so as to touch the mute fingerboard 13 during sounding can be minimized, and hence he/she can touch the mute fingerboard 13 without unwanted motion. Thus, even beginners inexperienced in performance can easily mute a musical tone.

According to the present embodiment, all the strings can be muted by a simple operation. Also, the circuit configurations and software processing can be less complicated as compared with the case where strings are muted independently of each other.

Figure 5:
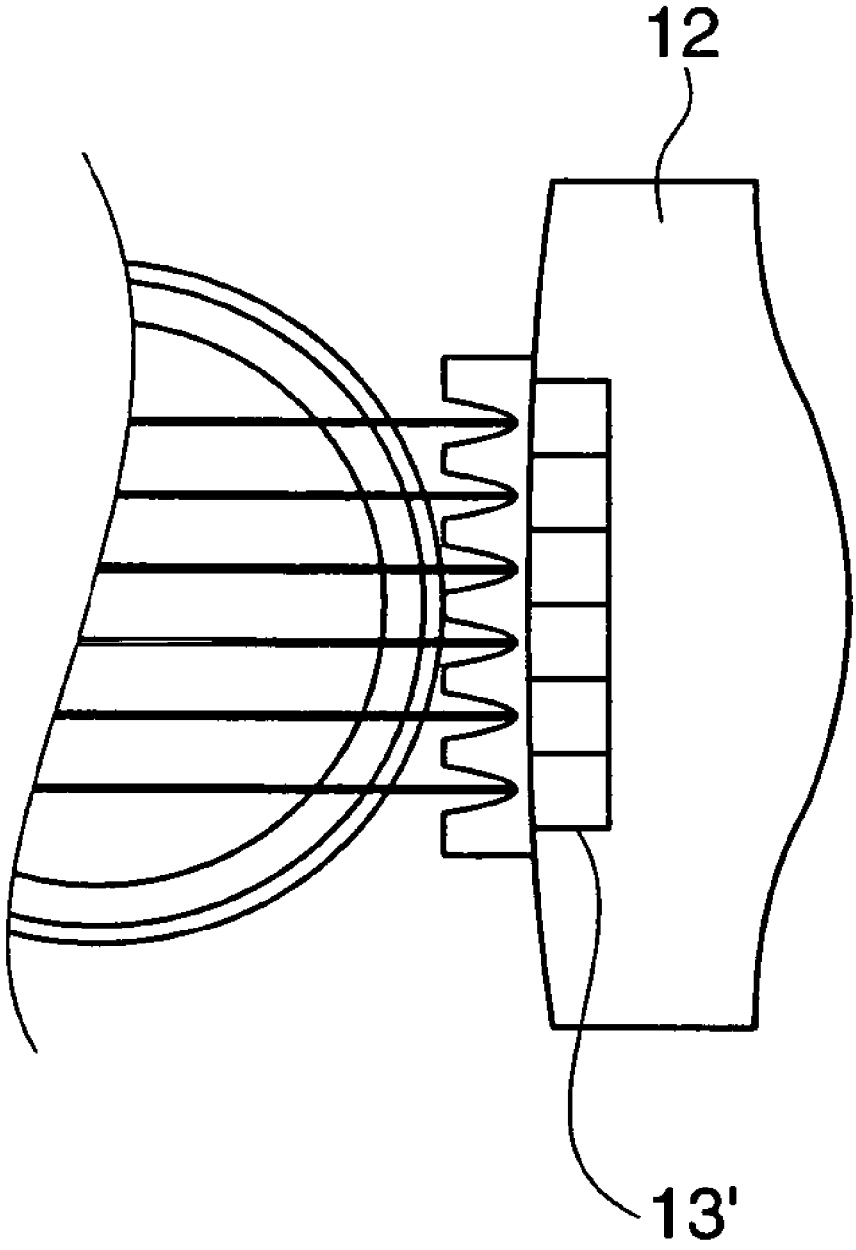
FIG. 5 is a fragmentary plan view showing essential parts of an electronic musical instrument according to a variation of the present invention.

Although in the present embodiment, one mute fingerboard 13 is provided for all the stringed operating elements 51, this is not limitative, but, as shown in FIG. 5, the mute fiberboard 13 may be divided into small pieces corresponding to the respective stringed operating elements 51 so that musical tones being sounded by plucking the respective stringed operating elements 51 can be muted independently of each other. In this case, if it is configured such that the electronic musical instrument has a mode in which all the stringed operating elements 51 are muted at a time when any of the six mute fingerboards 13 is touched and a mode in which a musical tone being sounded by plucking the corresponding operating element 51 is independently muted when any of the six mute fingerboards 13 is touched, the player can practice and play the electronic musical instrument in a suitable manner according to his/her improvement.

Further, although in the present embodiment, the mute fingerboard 13 is disposed on the first surface 12*a* of the operating element holder protecting section 12, which is formed at a lower level than the second surface 12*b*, this is not limitative, but the mute fiberboard 13 may be disposed on e.g. the second surface 12*b* instead of the first surface 12*a* insofar as the mute fingerboard 13 is fixed to the body 1 and disposed and exposed in the vicinity of the operated element end 51*ep*. Alternatively, if the mute fingerboard 13 is disposed on the first surface 12*a*, the first surface 12*a* and the second surface 12*b* may be flush with each other, or the first surface 12*a* may be formed at a higher level than the second surface 12*b* on which usually the player's hand (touch portion HD) is placed. This alternative disposition can prevent the player's hand from inadvertently touching the mute fingerboard 13.

In particular, to prevent the mute fingerboard 13 from being carelessly touched, it is preferred that the mute fingerboard 13 is provided on the lower first surface 12*a*, and part of the mute fingerboard 13 corresponding to the stringed operating elements 51*c* and 51*d* is flush with the second surface 12*b*, and part of the mute fingerboard 13 corresponding to the stringed operating elements 51*a*, 51*b*, 51*e*, and 51*f* is arc-shaped such that it is convex outward so that the mute fingerboard 13 is lowered from the center thereof toward the end thereof in the direction in which the stringed operating elements 51 are arranged.

Although in the present embodiment, when muting, the musical tone level is lowered by a predetermined level, this is not limitative, but the musical tone level may be changed with time to artificially reproduce a change in envelope curve which occurs when an ordinary guitar is touched with a finger. Further, to simplify the arrangement, sounding may be stopped completely at a time by muting.

Further, although in the present embodiment, the six stringed operating elements 51 are provided, this is not limitative, but, for example, the present invention may be applied to a case where only one operating element (stringed operating element 51) is provided for determining sounding timing.

What is claimed is:

1. An electronic musical instrument comprising:

a body;

a neck;

a fingerboard provided on said neck;

a plurality of pitch determination operating elements provided on said fingerboard, for determining a pitch;

a plurality of sounding timing determination operating elements each having an operated end, provided on said body, for determining sounding timing;

a musical tone generating device that generates musical tones according to operations of said pitch determination operating elements and said plurality of sounding timing determination operating elements; and at least one mute fingerboard that comes into contact with a part of a player's body to mute musical tones being sounded by said musical tone generating device and corresponding to operations of respective ones of said plurality of sounding timing determination operating elements, wherein said mute fingerboard is disposed and exposed in a vicinity of the operated end of said plurality of sounding timing determination operating elements, wherein said mute fingerboard comprises a single mute fingerboard disposed in the vicinity of the operated ends of all of said plurality of sounding timing determination operating elements for concurrently damping each of said plurality of sounding timing determination operating elements.

2. An electronic musical instrument comprising:

a fingerboard;

a plurality of pitch determination operating elements provided on said fingerboard, for determining a pitch;

a plurality of sounding timing determination operating elements each having an operated end, provided at a location other than said fingerboard, for determining sounding timing;

a musical tone generating device that generates musical tones according to operations of said pitch determination operating elements and said plurality of sounding timing determination operating elements; and at least one mute fingerboard that comes into contact with a part of a player's body to mute musical tones being sounded by said musical tone generating device and corresponding to operations of respective ones of said plurality of sounding timing determination operating elements, wherein said mute fingerboard is disposed and exposed in a vicinity of the operated end of said plurality of sounding timing determination operating elements, and wherein said mute fingerboard comprises a single mute fingerboard disposed in the vicinity of the operated ends of all of said plurality of sounding timing determination operating elements.

3. An electronic musical instrument comprising:

a fingerboard;

a plurality of pitch determination operating elements provided on said fingerboard, for determining a pitch;

a plurality of sounding timing determination operating elements each having an operated end, provided at a location other than said fingerboard, for determining sounding timing;

a musical tone generating device that generates musical tones according to operations of said pitch determination operating elements and said plurality of sounding timing determination operating elements;

at least one mute fingerboard that comes into contact with a part of a player's body to mute musical tones being sounded by said musical tone generating device and corresponding to operations of respective ones of said plurality of sounding timing determination operating elements; and an operating element holder protecting section having a surface, wherein said mute fingerboard is disposed and exposed in a vicinity of the operated end of said plurality of sounding timing determination operating elements, and wherein said plurality of sounding timing determination operating elements each have a latch engaged with said operating element holder protecting section, and said mute fingerboard is provided on the surface of said operating element holder protecting section.

4. An electronic musical instrument comprising:

a fingerboard;

a plurality of pitch determination operating elements provided on said fingerboard, for determining a pitch;

a plurality of sounding timing determination operating elements each having an operated end, provided at a location other than said fingerboard, for determining sounding timing;

a musical tone generating device that generates musical tones according to operations of said pitch determination operating elements and said plurality of sounding timing determination operating elements; and at least one mute fingerboard that comes into contact with a part of a player's body to mute musical tones being sounded by said musical tone generating device and corresponding to operations of respective ones of said plurality of sounding timing determination operating elements, wherein said mute fingerboard is disposed and exposed in a vicinity of the operated end of said plurality of sounding timing determination operating elements, and wherein said plurality of sounding timing determination operating elements are arranged transversely of the electronic musical instrument over a transverse region, and said mute fingerboard has a transverse size larger than the transverse region over which said plurality of sounding timing determination operating elements are arranged.

5. An electronic musical instrument as claimed in claim 3, wherein said operating element holder protecting section is stepped to have a first surface and a second surface lower than said first surface, and said mute fingerboard is disposed on said second surface of said operating element holder protecting section.

* * * * *